US009552009B2

(12) United States Patent
Hashitani et al.

(10) Patent No.: US 9,552,009 B2
(45) Date of Patent: Jan. 24, 2017

(54) REFERENCE VOLTAGE GENERATOR HAVING DIODE-CONNECTED DEPLETION MOS TRANSISTORS WITH SAME TEMPERATURE COEFFICIENT

(71) Applicant: SEIKO INSTRUMENTS INC., Chiba-shi, Chiba (JP)

(72) Inventors: Masayuki Hashitani, Chiba (JP); Hideo Yoshino, Chiba (JP)

(73) Assignee: SII Semiconductor Corporation (JP)

( * ) Notice: Subject to any disclaimer, the term of this patent is extended or adjusted under 35 U.S.C. 154(b) by 0 days.

(21) Appl. No.: 14/525,890

(22) Filed: Oct. 28, 2014

(65) Prior Publication Data

US 2015/0115930 A1 Apr. 30, 2015

(30) Foreign Application Priority Data

Oct. 28, 2013 (JP) ..... 2013-223367

(51) Int. Cl.

*G05F 3/24* (2006.01)
*G05F 3/16* (2006.01)
*G05F 3/20* (2006.01)

(52) U.S. Cl.

CPC . *G05F 3/16* (2013.01); *G05F 3/24* (2013.01); *G05F 3/20* (2013.01)

(58) Field of Classification Search

USPC ..... 323/304, 311–317
See application file for complete search history.

(56) References Cited

U.S. PATENT DOCUMENTS 5,467,052 A * 11/1995 Tsukada ..... G05F 3/24 327/331
5,629,542 A * 5/1997 Sakamoto ..... H01L 27/0629 257/146
6,653,694 B1 * 11/2003 Osanai ..... H01L 27/0883 257/392
2008/0111617 A1 * 5/2008 Krishna ..... G05F 3/30 327/543
2008/0246064 A1 * 10/2008 Kimura ..... H01L 27/14692 257/292

OTHER PUBLICATIONS

Patent Abstracts of Japan, Publication No. 56-108258, Publication Date Aug. 27, 1981.

* cited by examiner

*Primary Examiner* — Jeffrey Gblende
(74) *Attorney, Agent, or Firm* — Adams & Wilks

(57) ABSTRACT

A reference voltage generator has a first N type depletion MOS transistor configured to cause a constant current to flow, and a second N type depletion MOS transistor diode-connected to the first N type depletion MOS transistor and configured to generate a reference voltage based on the constant current. The first and second N type depletion MOS transistors have the same temperature coefficient of a threshold voltage. The first N type depletion MOS transistor has a buried channel into which arsenic impurities are diffused. The second N type depletion MOS transistor has a buried channel into which phosphorous impurities are diffused.

7 Claims, 3 Drawing Sheets

REFERENCE VOLTAGE GENERATOR HAVING DIODE-CONNECTED DEPLETION MOS TRANSISTORS WITH SAME TEMPERATURE COEFFICIENT

BACKGROUND OF THE INVENTION

1. Field of the Invention

The present invention relates to a reference voltage generator for generating a reference voltage within a semiconductor integrated circuit.

2. Description of the Related Art

A circuit used in a reference voltage generator in the related art is described with reference to FIG. 4. FIG. 4 is a circuit diagram of the reference voltage generator in the related art. A depletion NMOS transistor (hereinafter referred to as a D type NMOS transistor) 9 which is connected so as to function as a current source causes a constant current to flow into a diode-connected enhancement NMOS transistor (hereinafter referred to as an E type NMOS transistor) 10. By causing this constant current to flow into the E type NMOS transistor 10, a reference voltage corresponding to threshold voltages and sizes of the respective transistors is generated in the E type NMOS transistor 10.

First of all, a basic structure of the reference voltage generator is now described with reference to a schematic cross-sectional view of FIG. 5. The reference voltage generator includes a D type NMOS transistor) 9 and an E type NMOS transistor 10.

The D type NMOS transistor 9 which is connected so as to function as a current source includes a buried channel 12 so that the D type NMOS transistor 9 operates with a threshold value in a depletion region. In addition, a drain 17 is used as a power source terminal, and a gate electrode 13 and a source 16 are each connected to a reference voltage generation terminal. By adopting such a connection form, the D type NMOS transistor 9 described above functions as a constant current source. On the other hand, the E type NMOS transistor 10 which is diode-connected to the D type NMOS transistor 9 described above includes a surface channel 11 so that the E type NMOS transistor 10 operates with a threshold value in an enhancement region. In addition, a gate electrode 13 and a drain 15 are each connected to the reference voltage generation terminal, and a source 14 is connected to a ground terminal. That is, the D type NMOS transistor 9 and the E type NMOS transistor 10 are connected in series with each other. Therefore, when the D type NMOS transistor 9 and the E type NMOS transistor 10 are expressed in the form of an equivalent circuit, a circuit diagram illustrated in FIG. 4 is obtained.

Next, an operation of this reference voltage generator is described with reference to FIG. 3.

The D type NMOS transistor 9 described above operates as the constant current source. Therefore, for example, a drain current when a gate voltage with a grounded source is applied at regular intervals exhibits D type NMOS transistor characteristics 8 of FIG. 3 as transistor characteristics in this case. In FIG. 3, a threshold value of the D type NMOS transistor 9 is denoted by B, and the drain current is obtained at the gate voltage of 0 V. On the other hand, with respect to the E type NMOS transistor 10 described above, for example, a drain current when a gate voltage with the grounded source is applied at regular intervals similarly exhibits E type NMOS transistor characteristics 7 as the transistor characteristics. In FIG. 3, a threshold value of the E type NMOS transistor 10 is denoted by A. Here, the E type NMOS transistor 10 described above is diode-connected to the D type NMOS transistor 9 as the constant current source. Therefore, a gate voltage is required for causing a current to flow having the D type NMOS transistor characteristics 8 at the gate voltage of 0 V. This gate voltage is expressed by an output voltage C of FIG. 3 which becomes in turn an output from the reference voltage generator.

In the related art, as shown in Japanese Published Patent Application JP56-108258, the reference voltage generator is constructed in such a way that the D type NMOS transistor as the constant current source is operated in the depletion region by the buried channel, and the E type NMOS transistor diode-connected to the D type NMOS transistor is operated in the enhancement region by the surface channel. Here, the drain current characteristics for the gate voltage with the grounded source shown in FIG. 3 are especially important in the transistor characteristics. The drain current characteristics are electrical characteristics which are changed even by the change in temperature of the transistor. Because the temperature characteristics of the individual transistors constructing the reference voltage generator are different from one another, the temperature characteristics of the reference voltage generator are difficult to flatten over a wide temperature range.

In recent years, the improvement of the precision of an electronic apparatus has progressed, and the increased precision of an IC for controlling the electronic apparatus has been required. For example, in the IC, especially, a power management IC represented by a voltage detector or a voltage regulator, along with the miniaturization and the versatility of a portable apparatus to be loaded with the IC, it is required that even when a temperature is changed especially in the inside of the IC due to a change in ambient temperature environment, a reference voltage generator can generate a reference voltage with high precision, that is, temperature characteristics of the reference voltage become flatter.

SUMMARY OF THE INVENTION

The present invention has been made in view of the demand described above, and it is therefore an object of the present invention to provide a reference voltage generator having flatter temperature characteristics.

In order to solve the problem described above, a reference voltage generator according to one embodiment of the present invention includes a D type NMOS transistor configured to function as a current source, and a transistor which is diode-connected to the D type NMOS transistor so as to cause a constant current to flow thereinto and which has a circuit configuration of a D type NMOS transistor having the same temperature coefficient as that of the D type NMOS transistor, to thereby have flatter temperature characteristics.

As set forth hereinabove, according to one embodiment of the present invention, the reference voltage generator includes the D type NMOS transistors having the same temperature coefficient, to thereby improve the temperature characteristics of the reference voltage generator.

DETAILED DESCRIPTION OF THE EMBODIMENT

Now, an embodiment of the present invention is described with reference to the attached drawings.

Figure 1A:
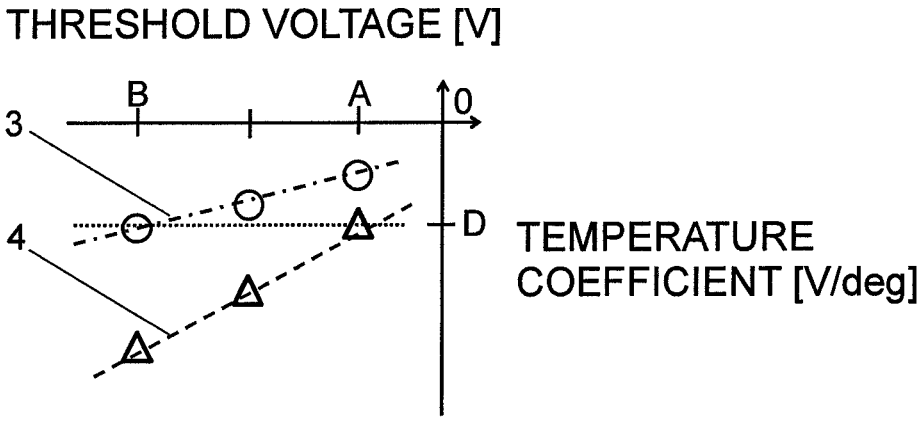
FIG. 1A is a schematic characteristic graph of a transistor constructing a reference voltage generator according to an embodiment of the present invention.

Firstly, the features of the present invention are described with reference to FIG. 1A. FIG. 1A is a schematic characteristic graph showing dependency of a temperature coefficient on a threshold value of NMOS transistors serving as D type MOS transistors of a first conductivity type with respect to a first NMOS transistor having temperature characteristics 3, and a second NMOS transistor having temperature characteristics 4. The temperature coefficient means an average rate of change in a defined temperature range of a physical quantity of interest. In this case, the temperature coefficient is a temperature coefficient of a threshold voltage. Here, a conductivity type of impurities to be diffused into a channel region is an N type in order to set the NMOS transistor to be a D type. Hence, the channel region serves as a buried channel. The first NMOS transistor and the second NMOS transistor have different temperature coefficients because the first NMOS transistor and the second NMOS transistor are different in kind of impurities for determining a threshold value, profile as distribution in a depth direction, and geometrical size.

In addition, for example, the reference voltage generator includes the two NMOS transistors: the first NMOS transistor having a temperature coefficient D in FIG. 1A and the threshold voltage B; and the second NMOS transistor having the temperature coefficient D in FIG. 1A and the threshold voltage A. In other words, the two NMOS transistors having the same temperature coefficient construct the reference voltage generator. The reason for this is because a reference voltage generated from the reference voltage generator having the configuration described above is basically determined by a difference between the threshold values of the two NMOS transistors.

Moreover, the reason for this is also because the adjustment of the geometrical sizes of the two NMOS transistors can determine a difference between the threshold values of the two NMOS transistors. For this reason, when the reference voltage generator includes the two NMOS transistors having the same temperature coefficient, the reference voltage as the difference between the threshold voltages can be made approximately constant even if the temperature changes. The threshold voltage A and the threshold voltage B of the respective transistors can be adjusted. For example, the profile of the channel region can be adjusted by using an ion implantation method. Impurities used in this case can be, for example, arsenic for the first NMOS transistor, and phosphorous for the second NMOS transistor.

Figure 1B:
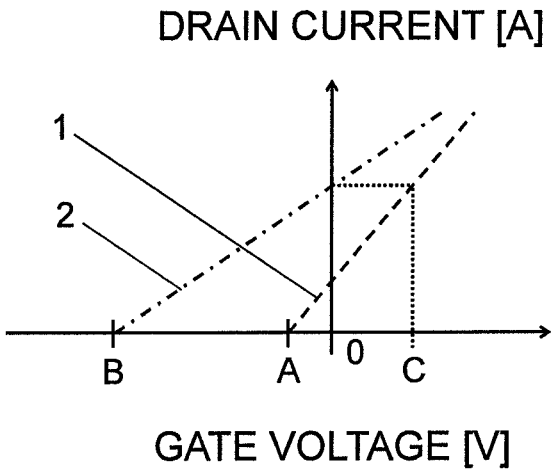
FIG. 1B is another schematic characteristic graph of the transistor constructing the reference voltage generator according to the embodiment of the present invention.
Figure 3:
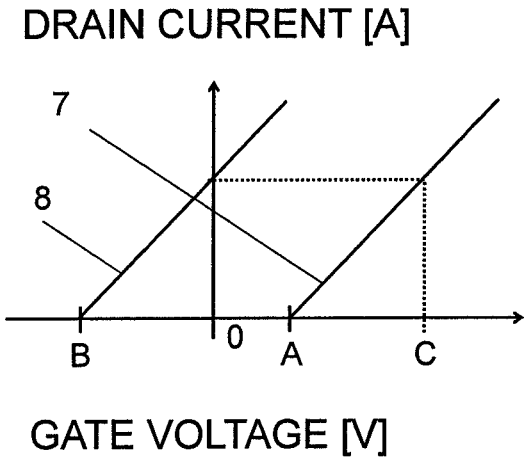
FIG. 3 is a schematic characteristic graph of a transistor constructing a reference voltage generator illustrating the related art.
Figure 4:
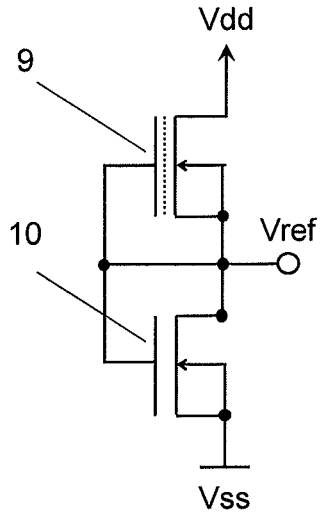
FIG. 4 PRIOR ART
FIG. 4 is a schematic circuit diagram of the reference voltage generator illustrating the related art.
Figure 5:
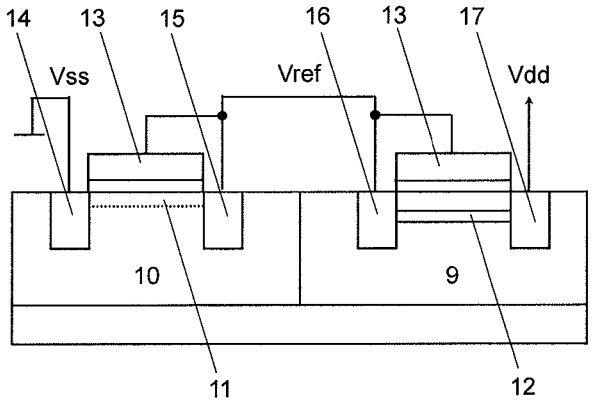
FIG. 5 PRIOR ART
FIG. 5 is a schematic cross-sectional view of the reference voltage generator illustrating the related art.

In addition thereto, with respect to the electrical characteristics of the transistor in this case, as shown in FIG. 1B, the second NMOS transistor having the threshold voltage A has characteristics 1, and the first NMOS transistor having the threshold voltage B has characteristics 2. An output C from the reference voltage generator can be obtained in accordance with the operating principles described above with reference to FIG. 3 by using the difference between the output voltages from those two NMOS transistors.

Figure 2:
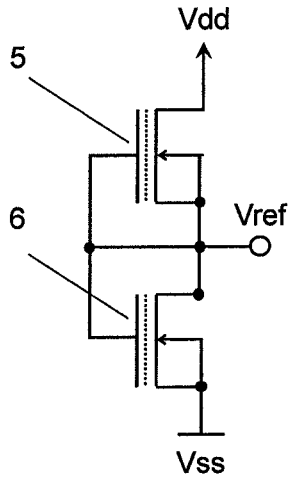
FIG. 2 is a schematic circuit diagram of the reference voltage generator according to the embodiment of the present invention.

In the case described above, a schematic circuit diagram of the reference voltage generator is as illustrated in FIG. 2. Hence, the first D type NMOS transistor 5 having the threshold voltage B serves as the constant current source, and the second D type NMOS transistor 6 having the threshold voltage A is diode-connected to the first D type NMOS transistor 5, to thereby construct the reference voltage generator.

As a result, the reference voltage generator including the two D type NMOS transistors having the same temperature coefficient as the feature of the present invention can have the flat temperature characteristics.

What is claimed is:

1. A reference voltage generator, comprising:

a first N type depletion MOS transistor configured to cause a constant current to flow; and a second N type depletion MOS transistor that is diode-connected to the first N type depletion MOS transistor, has the same temperature coefficient of a threshold voltage as a temperature coefficient of a threshold voltage of the first N type depletion MOS transistor, and is configured to generate a reference voltage based on the constant current;

wherein the second N type depletion MOS transistor has a buried channel into which phosphorous impurities are diffused, and the first N type depletion MOS transistor has a buried channel into which arsenic impurities are diffused.

2. A reference voltage generator according to claim 1, wherein the reference voltage is a difference between the threshold voltage of the first N type depletion MOS transistor and the threshold voltage of the second N type depletion MOS transistor.

3. A semiconductor integrated circuit having the reference voltage generator according to claim 1.

4. A reference voltage generator comprising:

a first depletion mode MOS transistor for supplying a constant current flow, the first depletion mode MOS transistor having a buried channel into which arsenic impurities are diffused; and a second depletion mode MOS transistor having a diode connection to the first depletion mode MOS transistor, having the same temperature coefficient as that of the first depletion mode MOS transistor, having a buried channel into which phosphorous impurities are diffused, and generating a reference voltage based on a constant current.

5. A reference voltage generator according to claim 4, wherein the reference voltage generated by the second depletion mode MOS transistor is a difference between a threshold voltage of the first depletion mode MOS transistor and a threshold voltage of the second depletion mode MOS transistor.

6. A reference voltage generator according to claim 4, wherein the first depletion mode MOS transistor and the second depletion mode MOS transistor have the same conductivity type.

7. A semiconductor integrated circuit having the reference voltage generator according to claim 4.

* * * * *